US006202217B1

(12) United States Patent
Karall

(10) Patent No.: US 6,202,217 B1
(45) Date of Patent: Mar. 20, 2001

(54) DEVICE FOR THE PROTECTION OF OBJECTS OR BODY PARTS AGAINST VIBRATIONS, IN PARTICULAR A VIBRATION-DAMPING GLOVE OR ANTIVIBRATION GLOVE

(75) Inventor: Gerhard Karall, Neunkirchen (AT)

(73) Assignee: Astron Elastomerprodukte Gesellschaft m.b.H. (AT)

( * ) Notice: Subject to any disclaimer, the term of this patent is extended or adjusted under 35 U.S.C. 154(b) by 0 days.

(21) Appl. No.: 09/371,410

(22) Filed: Aug. 10, 1999

(30) Foreign Application Priority Data

Aug. 11, 1998 (AT) ..... 1383/98

(51) Int. Cl.[7] ..... A41D 19/00
(52) U.S. Cl. ..... 2/161.6; 2/16; 2/163
(58) Field of Search ..... 2/16, 20, 21, 456, 2/159, 161.1, 161.2, 161.5, 161.6, 163, 167, 169

(56) References Cited

U.S. PATENT DOCUMENTS

| | | | | |
|---|---|---|---|---|
| 1,885,572 | * | 11/1932 | Wood | 2/159 |
| 4,610,034 | * | 9/1986 | Johnson | 2/2 |
| 4,783,853 | * | 11/1988 | Zuber | 2/2 |
| 5,014,358 | * | 5/1991 | Matumori | 2/94 |
| 5,274,846 | * | 1/1994 | Kolsky | 2/2 |
| 5,330,249 | * | 7/1994 | Weber et al. | 297/214 |
| 5,335,463 | | 8/1994 | Reinhall . | |
| 5,500,956 | | 3/1996 | Schulkin et al. . | |
| 5,537,688 | | 7/1996 | Reynolds et al. . | |
| 5,557,803 | * | 9/1996 | Granich et al. | 2/16 |
| 5,600,853 | * | 2/1997 | Yewer, Jr. | 2/161.1 |
| 5,632,045 | | 5/1997 | Chase et al. . | |
| 5,669,080 | * | 9/1997 | Culton | 2/455 |
| 5,673,437 | * | 10/1997 | Chase et al. | 2/167 |
| 5,987,642 | * | 11/1999 | Webster | 2/19 |

FOREIGN PATENT DOCUMENTS

| | | |
|---|---|---|
| 196 47 724 A1 | 11/1996 | (DE) . |
| WO 93/05670 | 9/1992 | (WO) . |
| WO 95/34228 | 6/1995 | (WO) . |

* cited by examiner

*Primary Examiner*—John J. Calvert
*Assistant Examiner*—Katherine Moran
(74) *Attorney, Agent, or Firm*—Samuels, Gauthier & Stevens

(57) ABSTRACT

There is disclosed a device for the protection of objects or body parts against vibrations, in particular a vibration-damping glove or antivibration glove, including at least one vibration-damping layer. In order to realize such a device, which causes noticeable damping of vibrations even in the low-frequency range of vibrations (31.5 to 200 Hz) and, in addition, remains maneuverable to the largest extent possible, at least one vibration-damping layer, on its surface facing away from the object or body part to be protected, includes indents for decoupling movements in at least one direction in the plane of that surface. The indents, on the one hand, cause the vibrations oriented in the plane of the surface to be deflected into the interior of the layer, thereby enhancing the vibration-damping effect, in particular in the low-frequency range. On the other hand, a high degree of movability of the vibration-damping layer, and hence of the overall device, is ensured by the indents.

12 Claims, 2 Drawing Sheets

DEVICE FOR THE PROTECTION OF OBJECTS OR BODY PARTS AGAINST VIBRATIONS, IN PARTICULAR A VIBRATION-DAMPING GLOVE OR ANTIVIBRATION GLOVE

BACKGROUND OF THE INVENTION

1. Field of the Invention

The invention relates to a device for the protection of objects or body parts against vibrations, in particular a vibration-damping glove or antivibration glove, including at least one vibration-damping layer.

2. Prior Art

Devices for the protection of the human body are known, for instance, as protectors for motorcyclists, which reduce the action of forces exerted on the body in the event of an accident involving crashing of the motorcyclist. DE 196 47 724 A1 describes protectors for protective motorcycle clothings, which are made of elastomers and include a base provided with elevations in the direction of the motorcyclist's body, which are aimed at providing an enhanced adaptability. Such protectors serve as protections against shocks or impacts. In order to reduce vibrations, gloves have been known, which, for instance, according to U.S. Pat. No. 5,632,045 A contain at least two layers of a damping material, one layer consisting of a viscoelastic material and one layer consisting of a foamed material. Another glove construction according to U.S. Pat. No. 5,537,688 A includes a plurality of interconnected liquid-containing blisters. Moreover, there are gloves for the protection against heat and mechanical influences, such as, for instance, the configuration according to WO 93/05670 A1, or gloves exhibiting an enhanced grip and adherence. Such a glove, in particular a goaltender's glove, is described, for instance, in WO 95/34228 A1.

The field of the present invention relates to both the protection of objects against vibrations and the protection of at least parts of the human or animal body. Whatever the cause of vibrations may be, in most cases it is moved systems which bring about undesired vibrations as side effects. By appropriately constructing the moved systems, it is sought to keep such vibrations low or shift the frequencies of vibrations to ranges in which they involve fewer drawbacks. It is, however, not possible to exlude vibrations completely. Therefore, various attempts have been made to prevent the transmission of vibrations to other objects or on man, or admit only a reduced portion of the same.

In particular, the operation of vibrating tools such as, e.g., grinding machines or the like, frequently leads to temporary or chronical injuries of the persons operating those machines. Such injuries are known as hand arm vibration syndrome. The consequences of such injuries are high sickness figures, low outputs and claims for damages, which constitute high economic losses.

The field, however, is not limited to vibrating machines. The devices, for instance, may serve also for protecting against vibrations in vehicles or the like.

In terms of frequency, vibrations may be subdivided into those occurring in the medium frequency range of approximately 31.5 to 200 Hz and those occurring in the high frequency range of above 200 Hz. Currently available protective devices such as, e.g., antivibration gloves are designed such that medium frequency range vibrations will not be increased and high frequency range vibrations will be lowered to a certain percentage. There have been known a number of antivibration gloves which cause the damping of vibrations by means of different materials in different material thicknesses. Thus, it is, for instance, possible to insert shaped parts of polyurethane, elastomers, silicon gel or polyolefine in a glove. In order to achieve sufficient vibration damping, those shaped parts in most cases are very thick, thus extremely restricting maneuverability. This cannot be tolerated in the application as a glove. If, on the other hand, the shaped parts are made so thin as to involve no substantial restriction of the freedom of motion, vibration damping will be insufficient. There are also known cases in which the device for the protection against vibrations will even increase the latter in certain frequency ranges.

SUMMARY OF THE INVENTION

It is, therefore, the object of the present invention to provide a device for the protection against vibrations, by which noticeable damping of vibrations can be achieved even in the low-frequency range of vibrations. Moreover, the device for the protection against vibrations is to be configured so as to allow for as large a freedom of motion as possible when applied to the human body, yet also no mechanical blocking will occur when applied directly on machines or the like.

The object of the invention is achieved in that at least one vibration-damping layer, on its surface facing away from the object or body part to be protected, comprises indents for decoupling movements in at least one direction in the plane of the said surface. The use of a vibration-damping layer comprising the indents according to the invention ensures that vibrations will be sufficiently damped even in the low-frequency range, i.e., from approximately 31.5 to 200 Hz while additionally providing as large a freedom of motion as possible. The surface of the vibration-damping layer, which is interrupted by the indents, is in direct or indirect contact with the source of vibration such that the vibrations can be effectively damped. When applying the device according to the invention as a protection against vibrations in the form of a vibration-damping glove, vibration-dependent injuries can, thus, be avoided and working can be continued over extented periods without frequent breaks and without the workers being jeopardized. Advantageously, the indents are arranged as a function of the geometry and the desired movability of the object or body part to be protected.

According to another characteristic feature of the invention, the depth of an indent amounts to at least 60%, preferably at least 80% and, in a particularly preferred manner, at least 95% of the thickness of the vibration-damping layer. Thereby, enhanced decoupling of the movements on the surface of the vibration-damping layer and hence enhanced vibration damping as well as an increased freedom of motion are achieved.

The width of the indents is at least so large that, at the maximum vibration-damping layer deformation possible, the layer formations located between the indents are at least partially decoupled from one another. Thereby, an optimum vibration-damping effect is obtained even at a deformation of the layer.

If the width of the indents increases in the direction of the surface of the vibration-damping layer, decoupling of the formations will be reached even at a deformation of the layer.

According to a further characteristic feature of the invention, at least one vibration-damping layer is comprised of a three-dimensional elastomer matrix, preferably based on polynorbonene, having vibration-damping plasticizers incorporated therein. Unlike gelatinous material groups, which exhibit a limited recovering behavior, an enhanced dimensional stability is achieved by means of a cross-linked elastomer matrix. By applying such a cross-linked structure, it is feasible to ensure optimum vibration damping even in the lower frequency ranges. This is achieved by the vibration-damping medium, in the instant case the vibration-damping plasticizer, being incorporated in the three-dimensional cross-linked elastomer matrix.

Good results are obtained if at least one vibration-damping layer has a hardness of 18 Shore A at most, preferably 5 Shore A, and a rebound elasticity of 10% at most, preferably 3% .

According to a further characteristic feature of the invention, the surface of the vibration-damping layer amounts to 20% to 80%, preferably 30%, of the base of the vibration-damping layer. The smaller the surface of the vibration-damping layer, the better the movability of the protective device. Yet, on the other hand, the surface must have a certain minimum measure in order maintain its functionality and the transmission of a retention force via the protective device, in particular when used as a glove. This will be assisted by the use of a harder material when choosing a smaller surface of the vibration-damping layer and a softer material when choosing a larger surface. The use of a material having a 18 Shore A hardness at an area portion of the surface facing the vibrating object of 20% of the base of the vibration-damping layer, a material having a 5 Shore A hardness at a 30% area portion and, finally, a material having a 3 Shore A hardness at a 80% area portion have proved to be particularly suitable.

BRIEF DESCRIPTION OF THE DRAWINGS

The invention will be explained in more detail by way of the accompanying drawings wherein.

DETAILED DESCRIPTION OF A PREFERRED EMBODIMENT OF THE INVENTION

Figure 1:
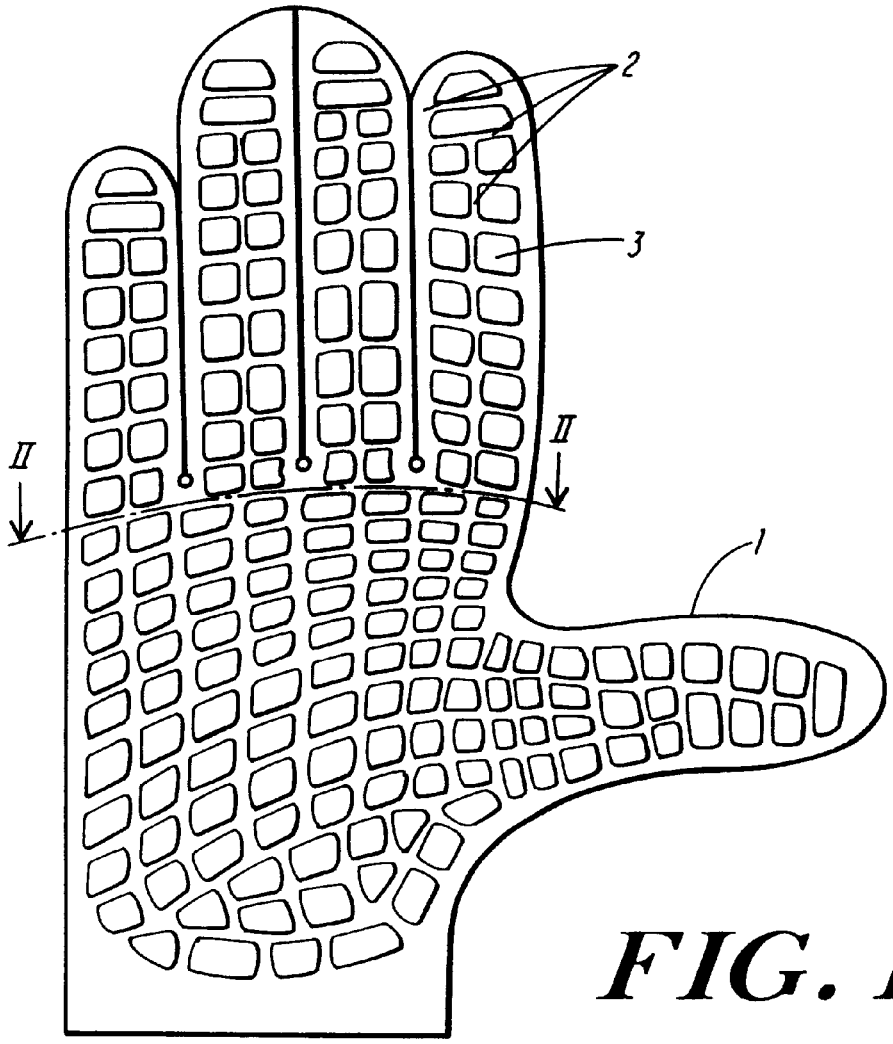
FIG. 1 is a top view on an embodiment of a vibration-damping layer according to the invention for use in a vibration-damping glove.

FIG. 1 in the top view illustrates an embodiment of a vibration-damping layer 1 according to the invention to be applied in a vibration-damping glove. The vibration-damping layer 1 is substantially shaped like a human hand and, according to the invention, comprises indents 2 on its surface, which are arranged as a function of the desired movement or geometry of the object to be protected, i.e., the human hand in the instant case. The arrangement of a plurality of indents 2 results in a plurality of intermediate formations 3. The vibration-damping layer 1 is configured such that the surface 4 of the formations 3 is located substantially parallel with the base 5 of the layer 1. The resulting surface 4 of the formations 3 in that case is to be as large as possible in order to provide for as large as possible an area of contact with the vibrating object. The sectional illustration according to FIG. 2 exemplifies a cross sectional shape of the indents 2. The configuration of the vibration-damping layer 1 according to the invention renders feasible that the vibrations oriented in the direction of the interior of the layer 1 are absorbed by the appropriate material and, in addition, any propagation of vibrations oriented in the direction of the plane of the surface 4 of the layer 1 is effectively prevented. Movements on the surface 4 on the indents 2 are partially forced into the interior of the vibration-damping layer 1, where, for instance, the conversion of vibration energy into heat takes place. Investigations have demonstrated that, due to the device according to the invention, vibrations both in the medium and in the high frequency ranges are markedly reduced and that the freedom of motion is preserved, nevertheless, in particular when used in a glove.

Figure 2:
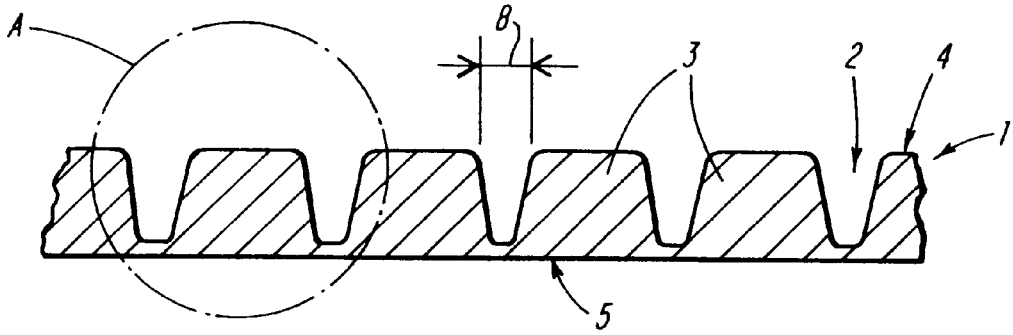
FIG. 2 is a sectional illustration through the layer along the sectional line II—II of FIG. 1.
Figure 3:
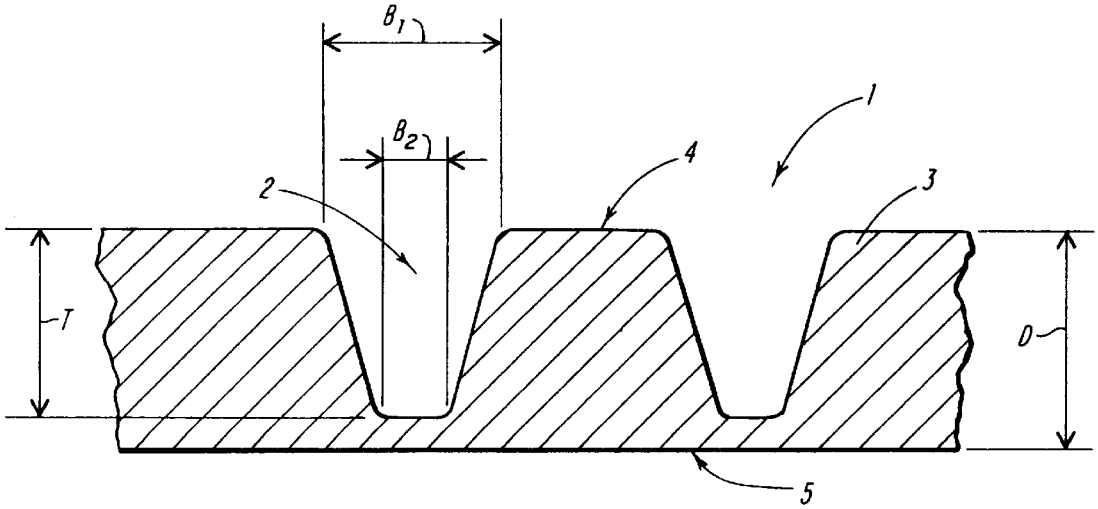
FIG. 3 depicts the detail A of FIG. 2 on an enlarged scale.

In FIG. 3, which depicts the detail A of FIG. 2 on an enlarged scale, preferred dimensional ratios are elucidated. The depth T of the indents 2 occupies a major portion of the thickness D of the vibration-damping layer 1. Advantageously, the depth T is at least 60%, preferably at least 80% and, in a particularly preferred manner at least 95%, of the thickness D of the layer 1. The width B of the indents is as small as possible so as to provide as large a surface 4 as possible via which the vibrations can be taken up, yet, at the same time, also at least so large as to prevent the transmission of movements in the direction of the plane of the surface 4 from one formation 3 to the adjacent formation 3. In the event the vibration-damping layer 1 may be exposed to a movement, as will, of course, be the case with a vibration-damping glove, the indents 2, in order to ensure sufficient decoupling of such movements in the direction of the plane of the surface 4 of the layer 1, must be selected to be at least of such a width that contacting of the formations 3 will be prevented even at the maximum deformation of the layer 1 possible. Sporadical contacting is, of course, tolerable, yet the major portion of the formations 3 should be mutually decoupled so as to ensure optimum vibration damping. In order to provide for the optimum movability of the layer 1, the indents 2 preferably are such that their width B increases in the direction of the surface 4 of the layer 1. This may be achieved, for instance, by a trapezoidal shape with the indents 2 on the surface 4 having a width $B_1$, larger than the width $B_2$ in the depth of the indents 2. Instead of a trapezoidal course, a curved or any other cross sectional course of the indents 2 may be chosen.

Figure 4:
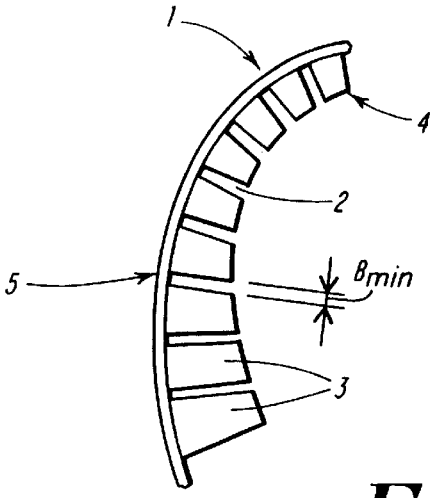
FIG. 4 shows part of a vibration-damping layer according to the invention in order to illustrate the desired movability.

FIG. 4 refers to a borderline case, showing the maximum deformation of the layer 1. When applied in a glove, such a maximum deformation is, for instance, a function of the maximum curvature possible of the fingers. The shape of the indents 2 in that case preferably is selected so as to ensure a certain minimum width $B_{min}$ of the indents 2 even upon such a maximum deformation so that mutual decoupling of the formations 3 will occur also in that state of the layer 1.

It goes without saying that various modifications may be realized within the scope of the invention. Thus, it is, for instance, possible to superimpose several layers 1, wherein different materials or material combinations may be employed. The indents 2 according to the invention may be arranged also on both surfaces 4, 5 of the vibration-damping layer 1. The application of the invention is not limited to gloves, either. Such devices for the protection against vibrations rather have manifold uses such as, e.g., in handles of motorcycles, vehicle seats or many more.

What I claim is:

1. A device for protecting an object or body part against vibrations, including at least one vibration-damping layer having a layer surface facing away from said object or body part to be protected, wherein said at least one vibration-damping layer, on said layer surface facing away from said object or body part to be protected, comprises a plurality of indents adapted to decouple movements in at least one direction in the plane of said layer surface, wherein said at least one vibration-damping layer is comprised of a three-dimensional elastomer matrix having vibration-damping plasticizers incorporated therein, to ensure optimum vibration damping even in the low-frequency range from approximately 31.5 to 200 Hz.

2. The device as set forth in claim 1, wherein said vibration-damping layer has a layer thickness and each of said indents has an indent depth amounting to at least 60% of said layer thickness of said vibration-damping layer.

3. The device as set forth in claim 1, wherein said vibration-damping layer has a layer thickness and each of said indents has an indent depth amounting to at least 80% of said layer thickness of said vibration-damping layer.

4. The device as set forth in claim 1, wherein said vibration-damping layer has a layer thickness and each of said indents has an indent depth amounting to at least 95% of said layer thickness of said vibration-damping layer.

5. The device as set forth in claim 1, wherein each of said indents has an indent width and said vibration-damping layer comprises a plurality of formations located between said plurality of indents, said indent width having a dimension such that, at the maximum deformation possible of said vibration-damping layer, said formations located between said indents are at least partially decoupled from one another.

6. The device as set forth in claim 5, wherein said indent width increases in the direction of said layer surface of said vibration-damping layer.

7. The device as set forth in claim 1, wherein said three-dimensional elastomer matrix is based on polynorbornone.

8. The device as set forth in claim 1, wherein said at least one vibration-damping layer has a maximum hardness of 18 Shore A and a maximum rebound resilience of 10%.

9. The device as set forth in claim 1, wherein said at least one vibration-damping layer has a maximum hardness of 5 Shore A and a maximum rebound resilience of 3%.

10. The device as set forth in claim 1, wherein said vibration-damping layer has a layer base and said layer surface of said vibration-damping layer amounts to 20% to 80% of said layer base of said vibration-damping layer.

11. The device as set forth in claim 1, wherein said vibration-damping layer has a layer base and said layer surface of said vibration-damping layer amounts to 30% of said layer base of said vibration-damping layer.

12. The device as set forth in claim 1, wherein said device is a vibration-damping glove or antivibration glove.

* * * * *